US008449327B2

(12) United States Patent
Low et al.

(10) Patent No.: US 8,449,327 B2
(45) Date of Patent: May 28, 2013

(54) INTERLEAVED OUTER CONDUCTOR SPRING CONTACT FOR A COAXIAL CONNECTOR

(75) Inventors: David Low, Frankfort, IL (US); Larry Buenz, Frankfort, IL (US); Jeffrey D. Paynter, St. Momence, IL (US)

(73) Assignee: Andrew LLC, Hickory, NC (US)

( * ) Notice: Subject to any disclaimer, the term of this patent is extended or adjusted under 35 U.S.C. 154(b) by 324 days.

(21) Appl. No.: 12/886,941

(22) Filed: Sep. 21, 2010

(65) Prior Publication Data

US 2011/0008998 A1 Jan. 13, 2011

Related U.S. Application Data

(63) Continuation-in-part of application No. 12/611,095, filed on Nov. 2, 2009, now Pat. No. 7,927,134, which is a continuation-in-part of application No. 12/264,932, filed on Nov. 5, 2008, now Pat. No. 7,806,724.

(51) Int. Cl.
*H01R 13/40* (2006.01)

(52) U.S. Cl.
USPC ..... 439/579

(58) Field of Classification Search
IPC ..... H01R 24/38
See application file for complete search history.

(56) References Cited

U.S. PATENT DOCUMENTS

| | | | | |
|---|---|---|---|---|
| 2,423,548 | A * | 7/1947 | Bels | 439/843 |
| 2,533,343 | A | 12/1950 | Bac | |
| 3,671,926 | A | 6/1972 | Nepovim | |
| 3,744,011 | A | 7/1973 | Blanchenot | |
| 3,757,279 | A | 9/1973 | Winston | |
| 3,761,870 | A | 9/1973 | Drezin et al. | |
| 3,855,568 | A * | 12/1974 | Cochrane | 439/668 |
| 4,519,666 | A * | 5/1985 | Williams et al. | 439/578 |
| 4,824,400 | A | 4/1989 | Spinner | |
| 4,923,412 | A | 5/1990 | Morris | |
| 5,267,877 | A | 12/1993 | Scannelli et al. | |
| 5,322,454 | A | 6/1994 | Thommen | |
| 5,352,134 | A | 10/1994 | Jacobsen et al. | |
| 5,795,188 | A | 8/1998 | Harwath | |
| 5,944,556 | A | 8/1999 | Wlos et al. | |

(Continued)

FOREIGN PATENT DOCUMENTS

| | | |
|---|---|---|
| EP | 0780924 | 6/1997 |
| WO | 2007101435 | 9/2007 |

OTHER PUBLICATIONS

International search report for counterpart application No. PCT/US2009/063315. Issued on Jun. 22, 1010.

(Continued)

*Primary Examiner* — Vanessa Girardi
(74) *Attorney, Agent, or Firm* — Babcock IP, PLLC

(57) ABSTRACT

A spring contact for a coaxial connector includes a first ring provided with a plurality of spring fingers extending toward a connector end of the first ring and a second ring provided with a plurality of spring fingers extending toward a connector end of the second ring. The first ring and the second ring are nested together. The spring contact may be manufactured, for example, by stamping a pre-form ring from a planar metal sheet and then bending the spring fingers extending radially inward from an inner diameter of the pre-form ring to extend towards a connector end of the resulting spring contact.

19 Claims, 14 Drawing Sheets

U.S. PATENT DOCUMENTS

| | | | |
|---|---|---|---|
| 5,967,852 | A | 10/1999 | Follingstad et al. |
| 6,019,636 | A | 2/2000 | Langham |
| 6,639,146 | B1 | 10/2003 | Chiu |
| 6,808,415 | B1 | 10/2004 | Montena |
| 6,848,939 | B2 | 2/2005 | Stirling |
| 7,011,546 | B2 | 3/2006 | Vaccaro |
| 7,156,696 | B1 | 1/2007 | Montena |
| 7,249,969 | B2 | 7/2007 | Paynter |
| 7,329,149 | B2 | 2/2008 | Montena |
| 7,335,059 | B2 | 2/2008 | Vaccaro |
| 2005/0164552 | A1 | 7/2005 | Wlos et al. |
| 2009/0325420 | A1 | 12/2009 | Paynter |

OTHER PUBLICATIONS

International search report for counterpart application No. PCT/US2009/063320. Issued on Jun. 22, 1010.

International Search Report, related application PCT/US2010/051799, issued Feb. 21, 2011 by European Patent Office, Netherlands.

* cited by examiner

INTERLEAVED OUTER CONDUCTOR SPRING CONTACT FOR A COAXIAL CONNECTOR

CROSS REFERENCE TO RELATED APPLICATIONS

This application is a continuation-in-part of commonly owned U.S. Utility patent application Ser. No. 12/611,095, titled "Insertion Coupling Coaxial Connector", filed Nov. 2, 2009 by Jeffrey Paynter and Al Cox, currently pending, hereby incorporated by reference in its entirety, which is a continuation-in-part of commonly owned U.S. Utility patent application Ser. No. 12/264,932,titled "Insertion Coupling Coaxial Connector", filed Nov. 5, 2008 by Jeffrey Paynter and Al Cox, currently pending, hereby incorporated by reference in its entirety.

BACKGROUND

1.Field of the Invention

This invention relates to electrical cable connectors. More particularly, the invention relates to an internal spring contact for a solid outer conductor coaxial cable connector.

2.Description of Related Art

Coaxial cable connectors are used, for example, in communication systems requiring a high level of precision and reliability.

To create a secure mechanical and optimized electrical interconnection between the cable and the connector, it is desirable to have generally uniform, circumferential contact between a leading edge of the coaxial cable outer conductor and the connector body. A flared end of the outer conductor may be clamped against an annular wedge surface of the connector body, via a coupling nut. Representative of this technology is commonly owned U.S. Pat. No. 5,795,188 issued Aug. 18, 1998 to Harwath.

Machine threaded coupling surfaces between the metal body and the metal coupling nut of U.S. Pat. No. 5,795,188 and similarly configured prior coaxial connectors significantly increase manufacturing costs and installation time requirements. Another drawback is the requirement for connector disassembly, sliding the back body over the cable end and then performing a precision cable end flaring operation, which retains the cable within the connector body during threading. Further, care must be taken at the final threading procedure and/or additional connector element(s) added to avoid damaging the flared end portion of the outer conductor as it is clamped between the body and the coupling nut to form a secure electrical connection between the outer conductor and the coaxial cable.

Alternative coaxial connector solutions, utilizing gripping/and or support elements about which the connector body is then radially crimped and/or axially compressed to secure an electromechanical interconnection between the outer conductor of the coaxial cable and the connector, are also known in the art. Crimped and/or compressed connections may be subject to varying quality depending upon the specific force level applied by the installer in each instance. Support surfaces added to prevent collapse of the outer conductor inserted within the inner diameter of the outer conductor, common in connectors for non-solid outer conductor coaxial cables, introduce an electrical performance degrading impedance discontinuity into the signal path. Further, crimping and/or compression becomes impractical with larger diameter coaxial cables, as the increased diameter, sidewall thickness and/or required travel of the corresponding connector/back body(s) increases the required force(s) beyond the levels deliverable by conventional crimp/compression hand tools.

Competition in the coaxial cable connector market has focused attention on improving electrical performance and minimization of overall costs, including materials costs, training requirements for installation personnel, reduction of dedicated installation tooling and the total number of required installation steps and/or operations.

Therefore, it is an object of the invention to provide a coaxial connector solution that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

The inventor analyzed available solid outer conductor coaxial connectors and recognized the drawbacks of threaded inter-body connection(s), manual flaring installation procedures and crimp/compression coaxial connector designs. Insertion coupling coaxial connectors, for example as disclosed in the inventor's commonly owned U.S. Utility patent application Ser. No. 12/264,932, titled "Insertion Coupling Coaxial Connector", filed Nov. 5, 2008, currently pending and hereby incorporated by reference in its entirety, introduces several significant improvements to the coaxial connector arts, eliminating the need for manual flaring of the outer conductor and/or high torque threading of the coupling nut into the connector body during outer conductor end clamping connector to cable end interconnection. Similarly, several improvements to the insertion coupling coaxial connector are disclosed in the inventors commonly owned U.S. Utility patent application Ser. No. 12/611,095, titled "Insertion Coupling Coaxial Connector", filed Nov. 2, 2009, currently pending, hereby incorporated by reference in its entirety.

The inventor's electrical performance analysis of the prior insertion coupling coaxial connectors has recognized that, in view of allowances made for diameter changes of outer conductor contacting elements of an insertion coupling connector during interconnection, an entirely circumferential connection may not be present around the outer conductor. Thereby, a significant level of RF leakage may occur through gap(s) in the spring contact and/or grip ring applied to the coaxial cable outer conductor outer diameter, the RF leakage eventually radiating out of a gap between the clamp ring and the outer conductor of the coaxial cable. RF leakage becomes especially significant as the operating frequency of signals transmitted along the coaxial cable increases towards higher microwave frequencies, which with shorter and shorter wavelengths are able to pass/leak through smaller and smaller gaps of the coaxial connector interconnection with the outer conductor of the coaxial cable.

Figure 1:
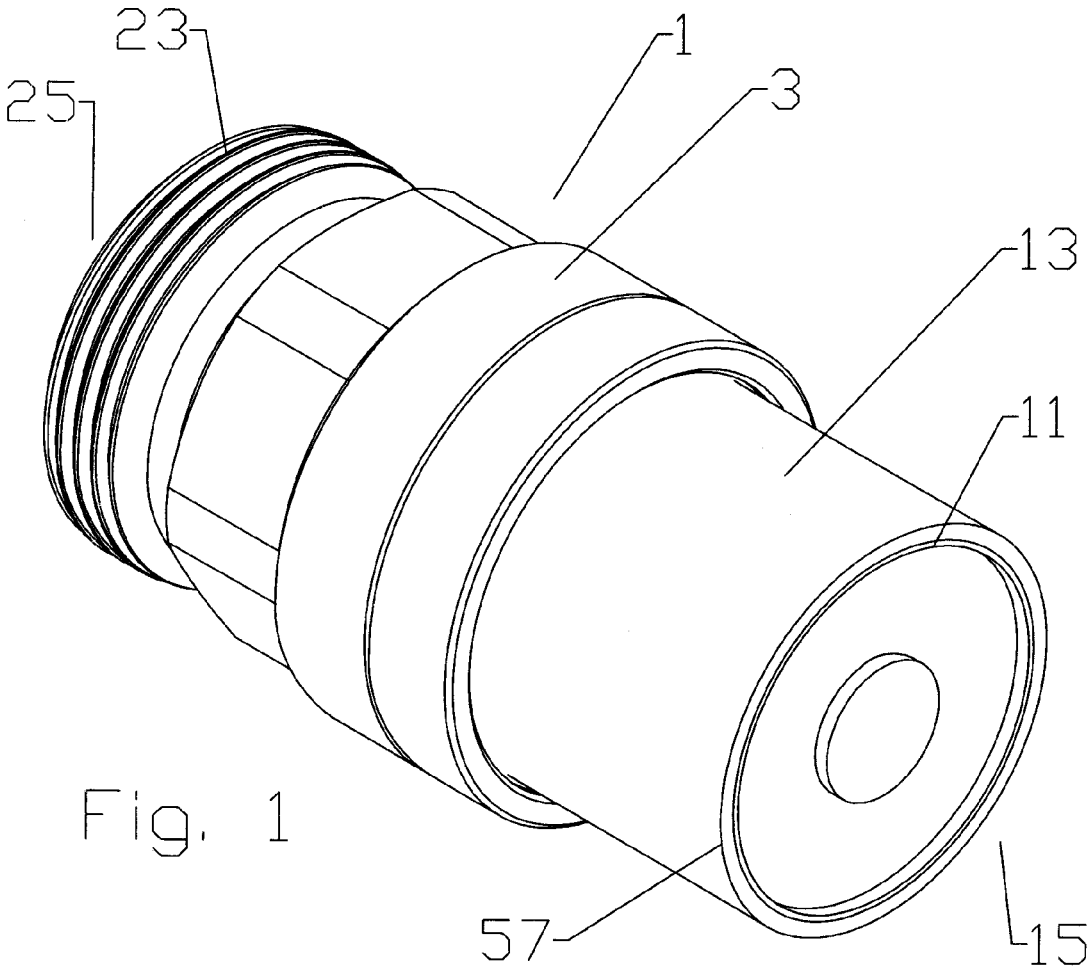
FIG. 1 is a schematic isometric rear view of a first exemplary embodiment of a coaxial connector.
Figure 2:
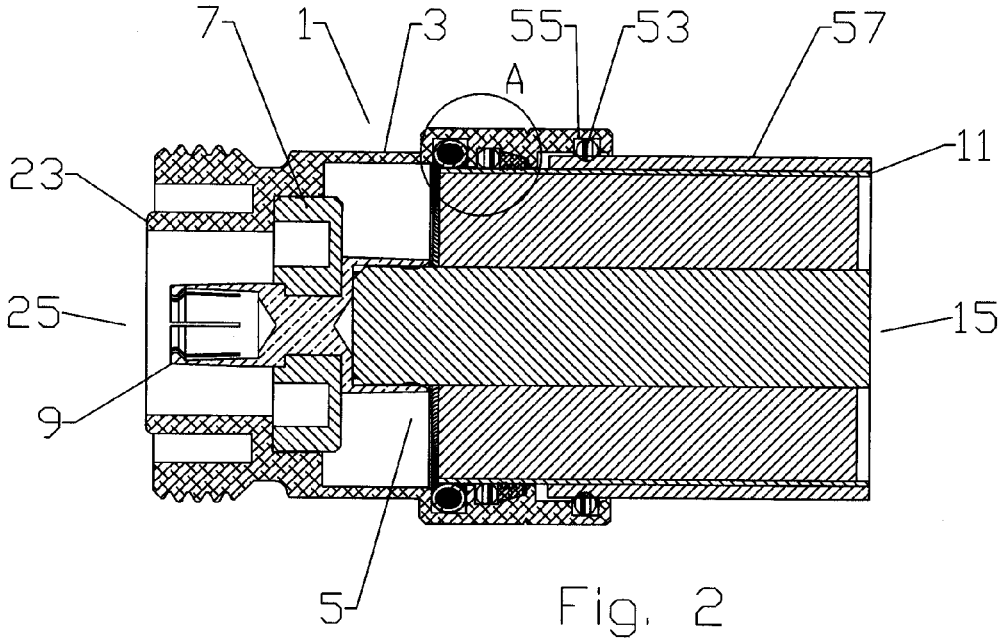
FIG. 2 is a schematic cross-section side view of the coaxial connector of FIG. 1, with a section of coaxial cable attached.
Figure 3:
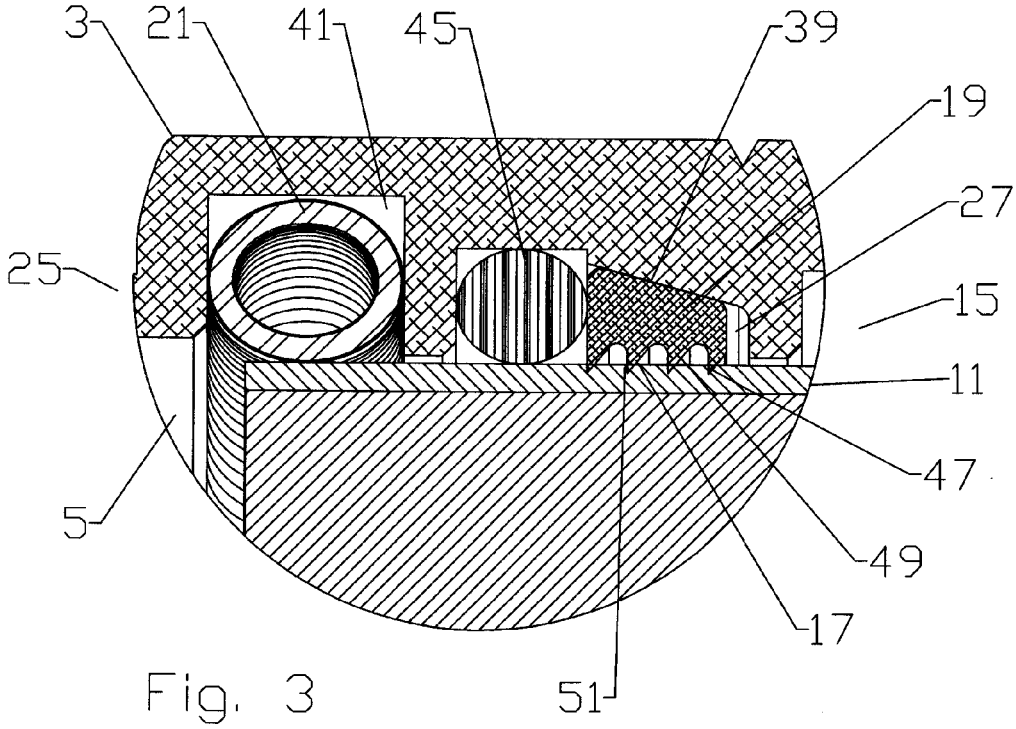
FIG. 3 is a close-up view of area A of FIG. 2.

As shown in a first exemplary embodiment in FIGS. 1-3, a coaxial connecter 1 has a connector body 3 with a connector body bore 5. An insulator 7 seated within the connector body bore 5 supports an inner contact 9 coaxial with the connector body bore 5. The coaxial connector 1 mechanically retains the outer conductor 11 of a coaxial cable 13 inserted into the cable end 15 of the connector body bore 5 via a grip surface 17 located on the inner diameter of a grip ring 19. A spring contact 21 seated within the connector body bore 5 makes circumferential contact with the outer conductor 11, proximate the end of the outer conductor 11, electrically coupling the outer conductor 11 across the connector body 3 to a connector interface 23 at the connector end 25.

The connector interface 23 may be any desired standard or proprietary interface.

One skilled in the art will appreciate that the cable end 15 and the connector end 25 are descriptors used herein to clarify longitudinal locations and contacting interrelationships between the various elements of the coaxial connector 1. In addition to the identified positions in relation to adjacent elements along the coaxial connector longitudinal axis, each individual element has a cable end side and a connector end side, i.e. the sides of the respective element that are facing the respective cable end 15 and the connector end 25 of the coaxial connector 1.

Figure 4:
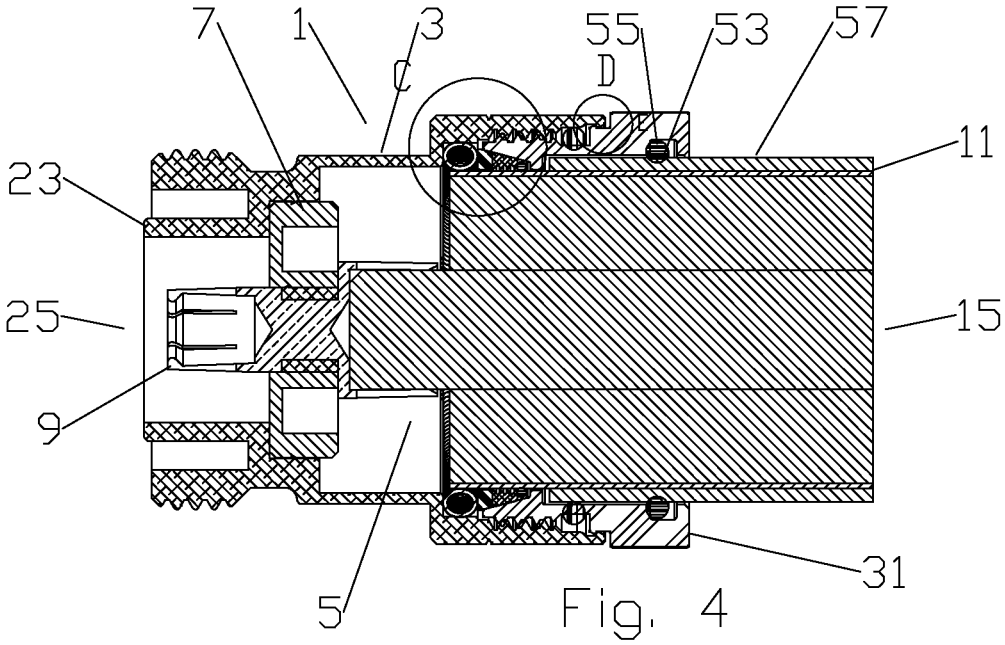
FIG. 4 is a schematic cross-section view of another alternative embodiment coaxial connector, with a section of coaxial cable attached.
Figure 5:
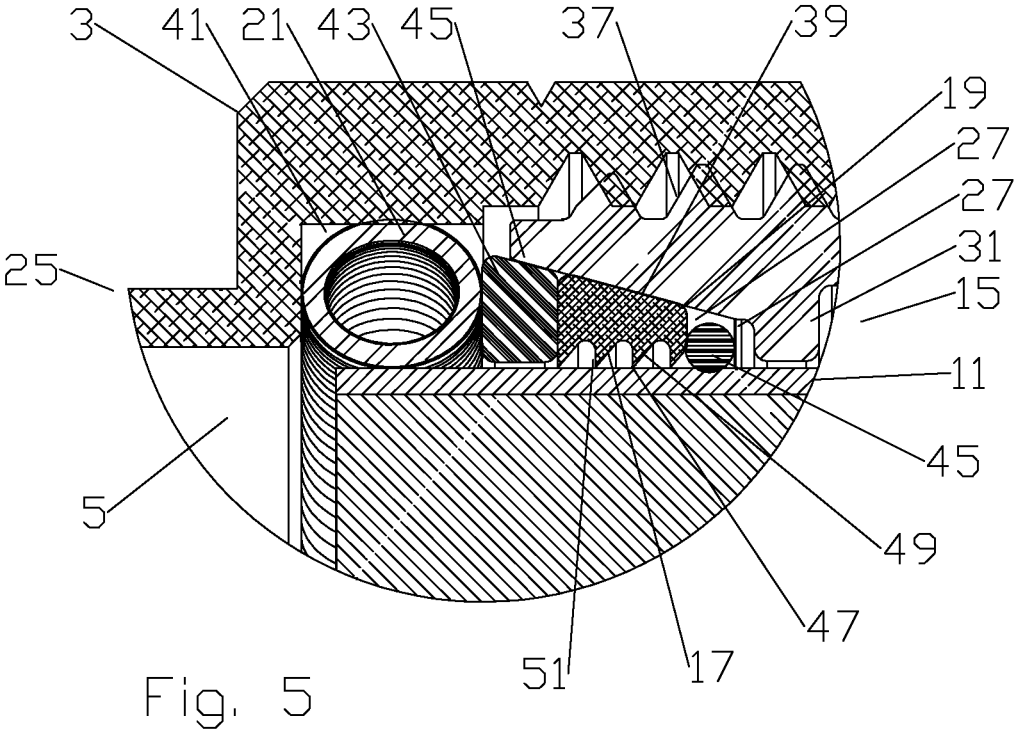
FIG. 5 is a close-up view of area C of FIG. 4.

The grip ring 19 may be retained within the connector body bore 5, for example seated within a grip ring groove 27. For ease of grip ring 19 installation (and further elements, if present, described herein below) installation and/or enhanced grip ring to outer conductor gripping characteristics, the grip ring groove 27 may be formed wherein the cable end grip ring groove sidewall and/or bottom are surfaces of a clamp nut 31 coupled to the connector body 3, for example as shown in FIGS. 4 and 5.

Figure 6:
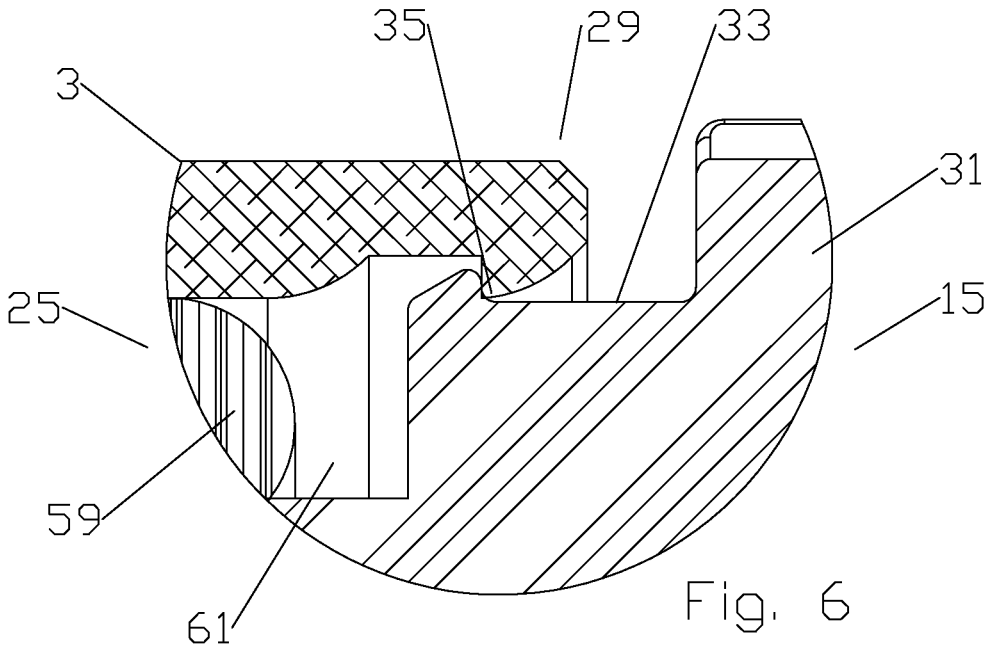
FIG. 6 is a close-up view of area D of FIG. 4.
Figure 7:
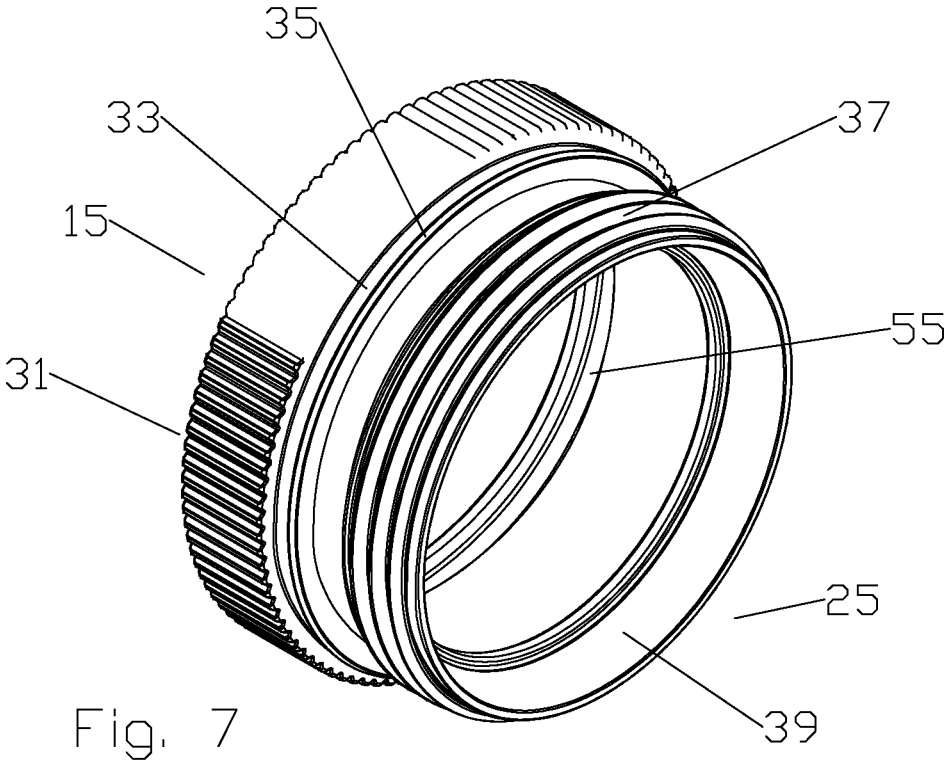
FIG. 7 is a schematic isometric view of the clamp ring of FIG. 4.

The clamp ring 31, if present, may be coupled to the connector body 3 by a retaining feature 29, such as an interlock between one or more annular snap groove(s) 33 in the outer diameter of the clamp ring and corresponding snap barb(s) 35 provided on an inner diameter of the connector body bore 5, as best shown for example in FIG. 6. Alternatively, the positions of the snap groove(s) 33 and the corresponding snap barb(s) 35 may be reversed.

Clamp ring threads 37 between the connector body bore 5 and an outer diameter of the clamp ring 31 may also be provided as an alternative to the retaining feature 29. To enable the coaxial connector 1 to be supplied as a ready-for-installation assembly, the clamp ring threads 37 may be combined with the snap groove 33 and snap barb 35 interconnection to provide an assembly that may be supplied with the clamp ring 31 already attached to the connector body 3, preventing disassembly and/or loss of the internal elements, as shown for example in FIGS. 4-7. Where the retaining feature 29 combines the clamp ring threads 37 with the snap groove 33 and snap barb 35, the longitudinal travel of the clamp ring 31 with respect to the connector body 3 via threading along the clamp ring threads 37 is limited by a width within the snap groove 33 across which the snap barb 35 may move before interfering with the snap groove sidewalls.

Figure 8:
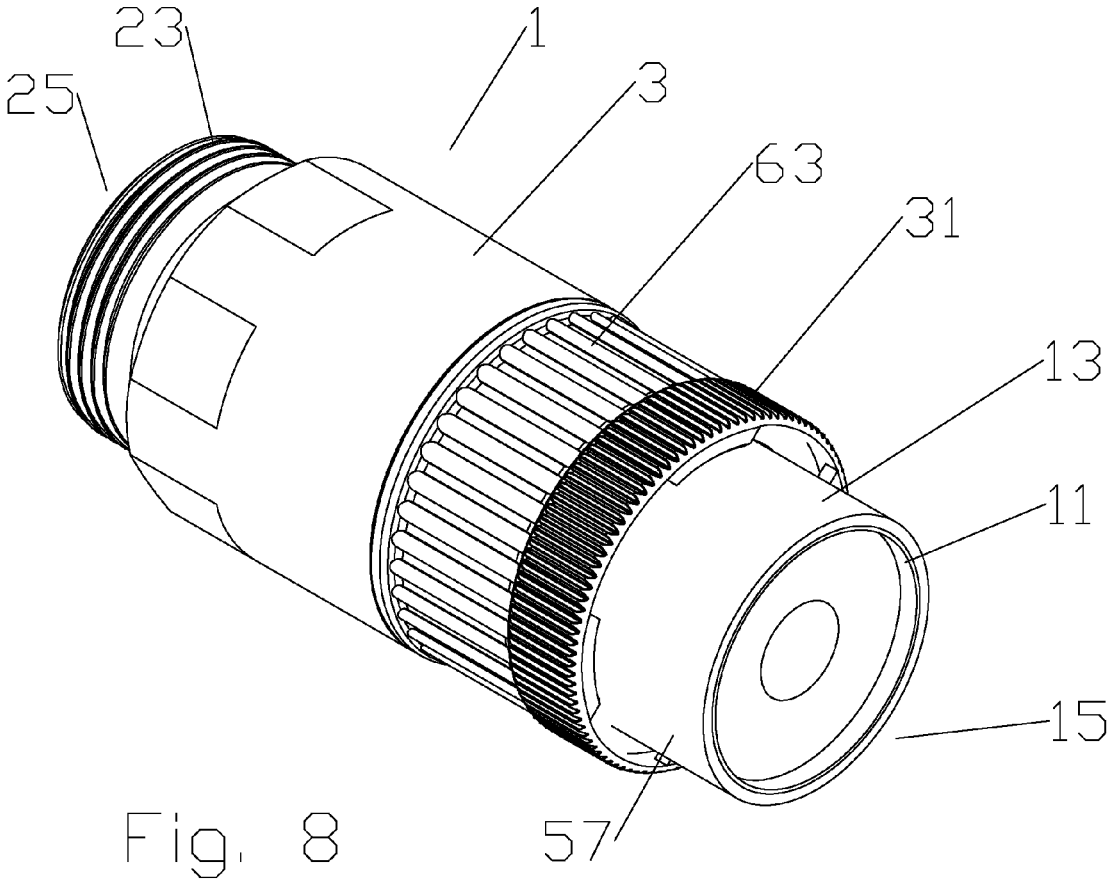
FIG. 8 is a schematic isometric view of another alternative embodiment of a coaxial connector.
Figure 9:
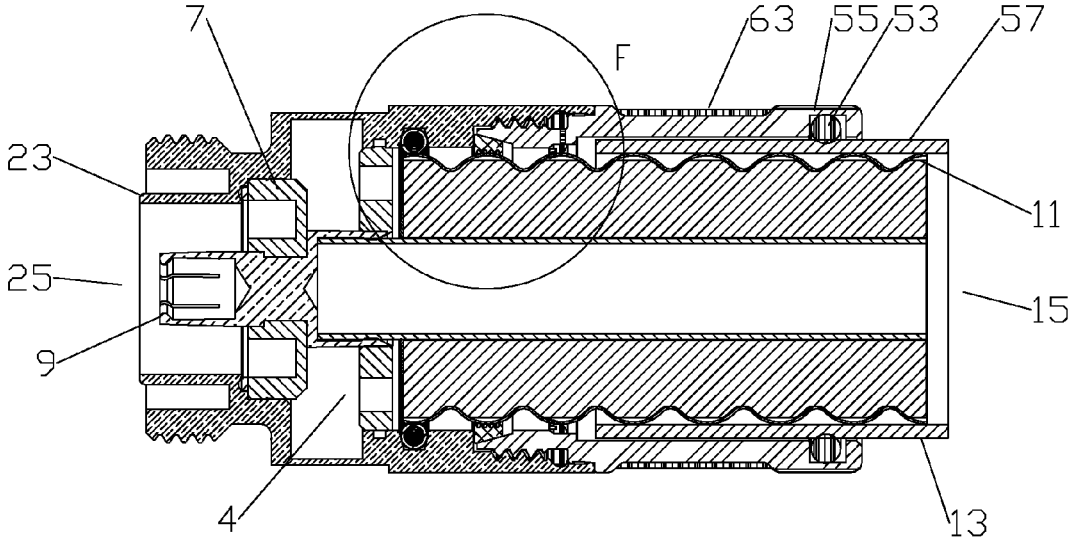
FIG. 9 is a schematic cross-section view of FIG. 8.
Figure 10:
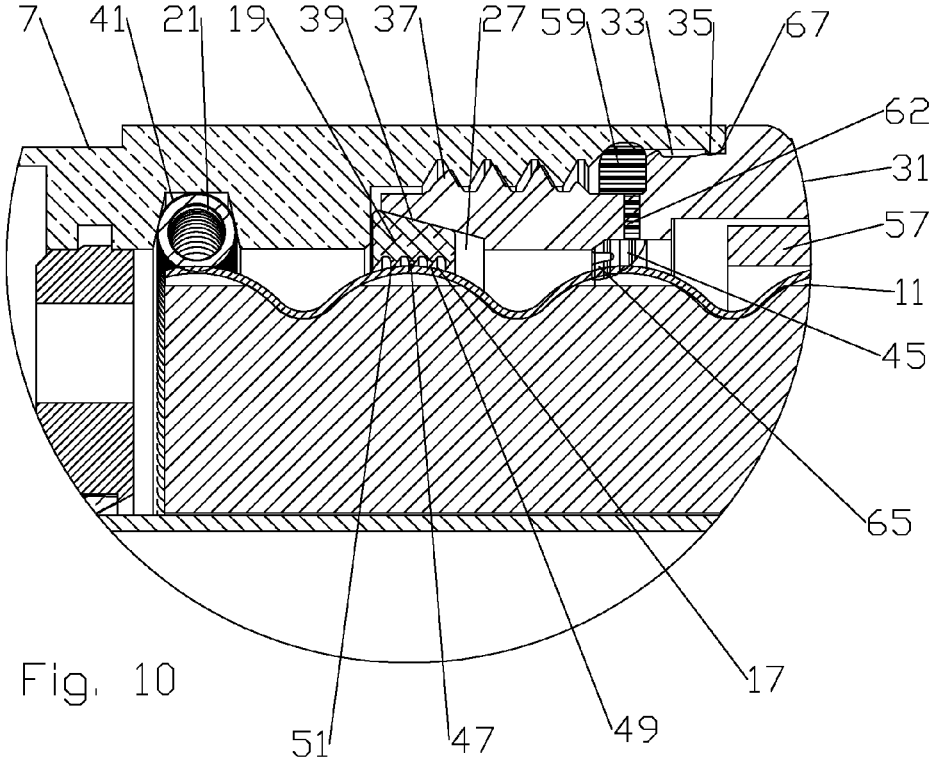
FIG. 10 is a close-up view of area F of FIG. 9.
Figure 11:
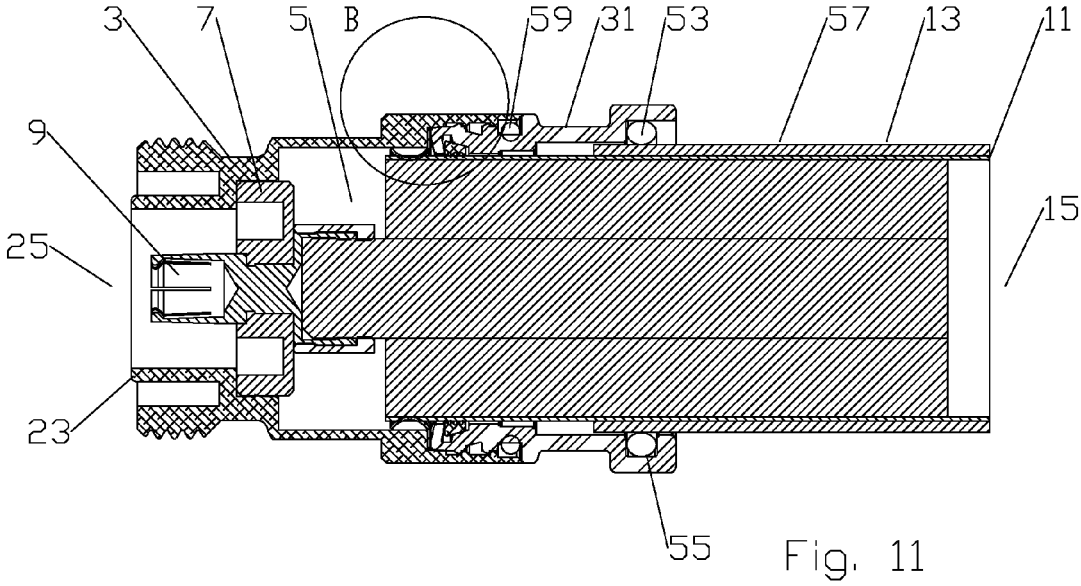
FIG. 11 is schematic cross-section view of another alternative embodiment of a coaxial connector.
Figure 12:
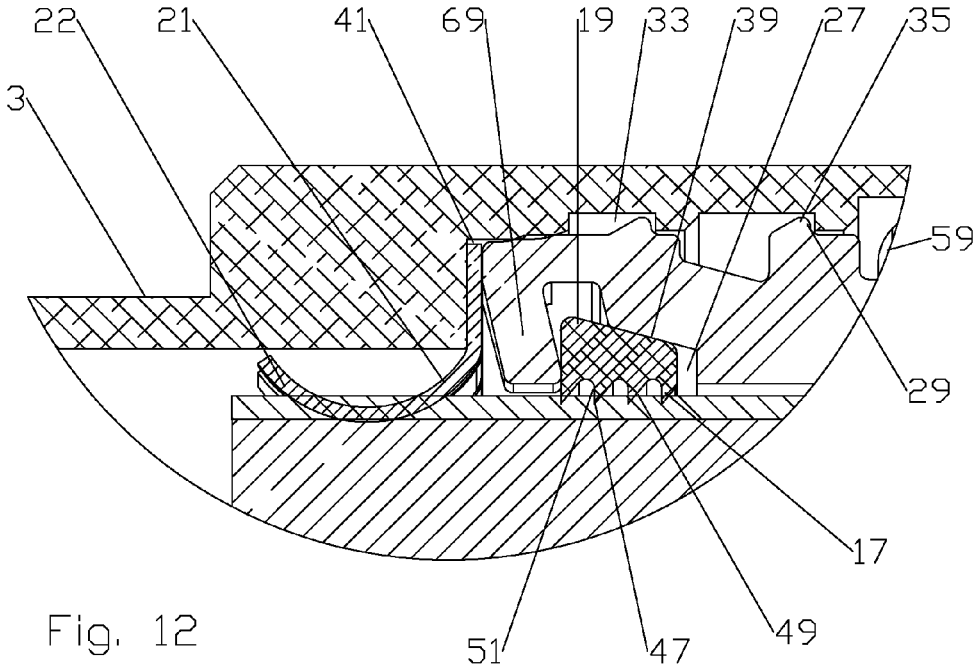
FIG. 12 is a close-up view of area B of FIG. 11.
Figure 13:
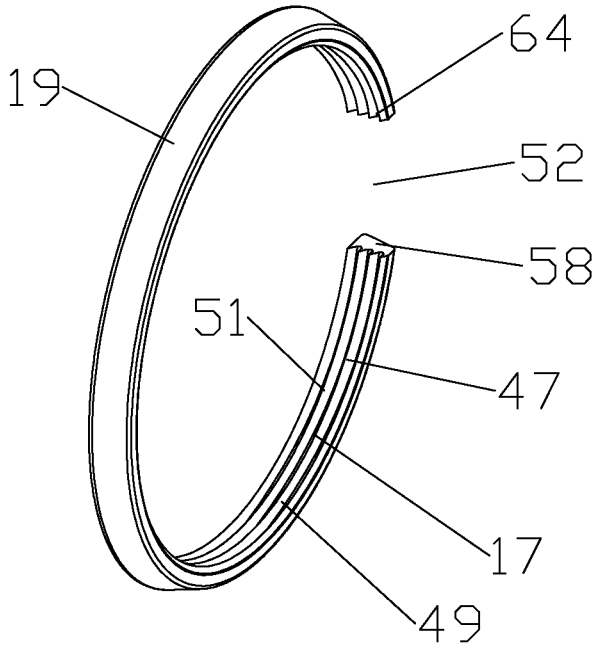
FIG. 13 is a schematic isometric view of a grip ring with a solid cross-section and annular barbs.

In an alternative embodiment demonstrated in FIGS. 8-10, the retaining feature 29 may also include an interference fit 67 between the connector body 3 and the clamp ring 31, positioned to engage during final threading together of the connector body 3 and the clamp ring 31. The interference fit 67 is operative to resist unthreading/loosening of the clamp ring 31 once threaded into the connector body 3.

The spring contact 21 may be any conductive structure with a spring characteristic, such as a helical coil spring. Referring again to FIGS. 2 and 3, the spring contact 21 may be seated in a separate spring groove 41 of the connector body bore sidewall or alternatively seated on a connector end side of the grip ring groove 27, for example as shown in FIGS. 4 and 5. Where the spring contact 21 is in the grip ring groove 27, a spacer 43 may be applied between the spring contact 21 and the grip ring 19 and/or an outer conductor seal 45. The spacer 43 may be seated directly against the connector body 3 or alternatively configured to seat against the wedge surface 39.

Alternatively, the spring contact 21 may be a stamped metal spring ring with a plurality of spring fingers 22, for example as shown in FIGS. 11, 12 and 20-27, retained in electrical contact with the connector body 3, for example, by the clamp ring 31 and/or grip ring 19.

Figure 20:
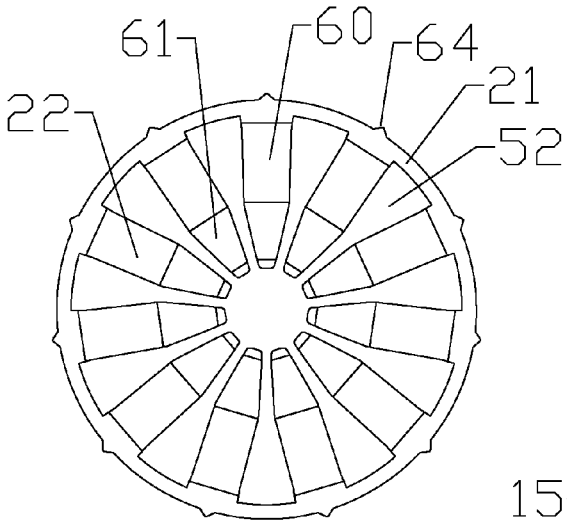
FIG. 20 is a schematic front view of a spring contact pre-form.
Figure 21:
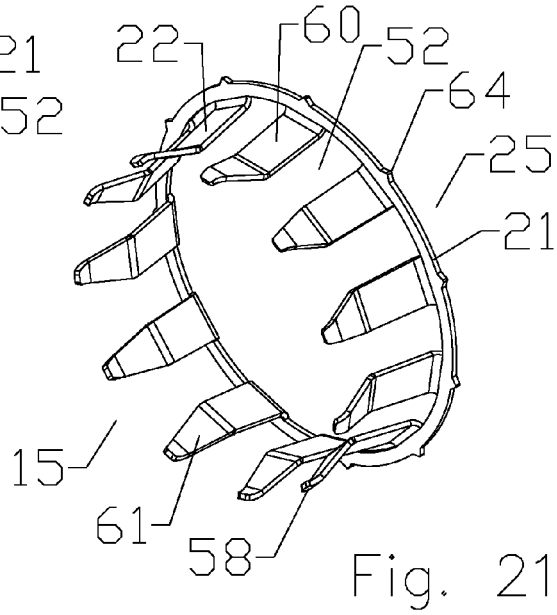
FIG. 21 is a schematic isometric view of the spring contact pre-form of FIG. 20.
Figure 22:
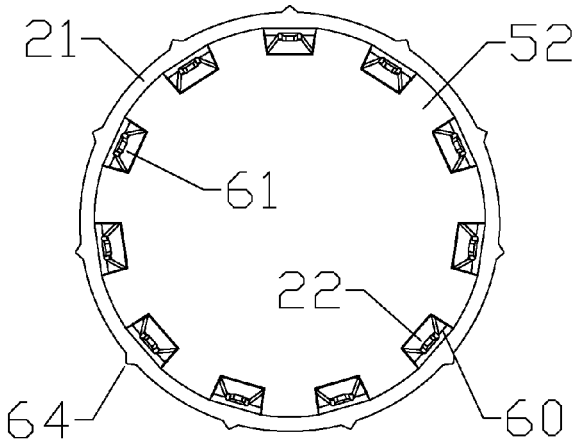
FIG. 22 is a schematic front view of FIG. 21.
Figure 23:
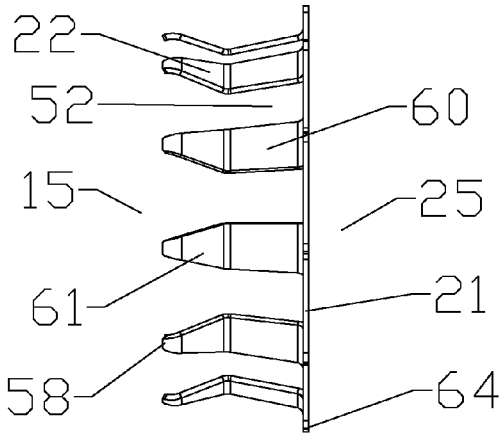
FIG. 23 is a schematic side view of FIG. 21.

As best shown in FIG. 20, the spring contact 21 may be cost effectively manufactured with a high level of precision by stamping a pre-form from planar metal sheet material, the spring finger(s) 22 stamped extending radially inward from an inner diameter of a ring. Once stamped, the spring finger(s) 22 of the pre-form are bent into the desired configuration, extending toward the connector end 25 of the resulting spring contact 21. One skilled in the art will appreciate that a diameter of the ring, length of the spring finger(s) 22, and a minimum separation for the stamp tool to define individual spring finger(s) 22 will necessarily limit a spacing of the spring finger(s) 22 circumferentially around the spring contact 21, requiring the presence of significant gap(s) 52 between the spring finger(s) 22, as shown for example in FIGS. 21-23. A length of the spring finger(s) 22 may be extended if a taper is applied proximate a distal end 58 of the spring finger(s) 22.

The extension of the spring finger(s) 22 towards the connector end 15 may be applied as a first portion 60 angled radially inward which transitions to a second portion 61 angled radially outward. The second portion 61 may be dimensioned with respect to the ring to bias against the sidewall of the connector body bore 5, upon insertion of the outer conductor 11 through the spring contact 21.

A protrusion 64 may be located projecting outward from an outer diameter of the ring, operative as an anti-rotation element. A plurality of protrusion(s) 64 may be applied, for example, each positioned proximate a circumferential position of a spring finger 22.

The inventors have discovered that, although a ferrous metal may be applied for materials cost purposes, application of a non-ferrous and thus non-magnetic metal, such as phosphor bronze, as the spring contact 21 metal material may significantly improve static passive intermodulation (PIM) characteristics of the resulting coaxial connector 1. The phosphor bronze may be plated, for example with tin, to minimize corrosion.

Figure 24:
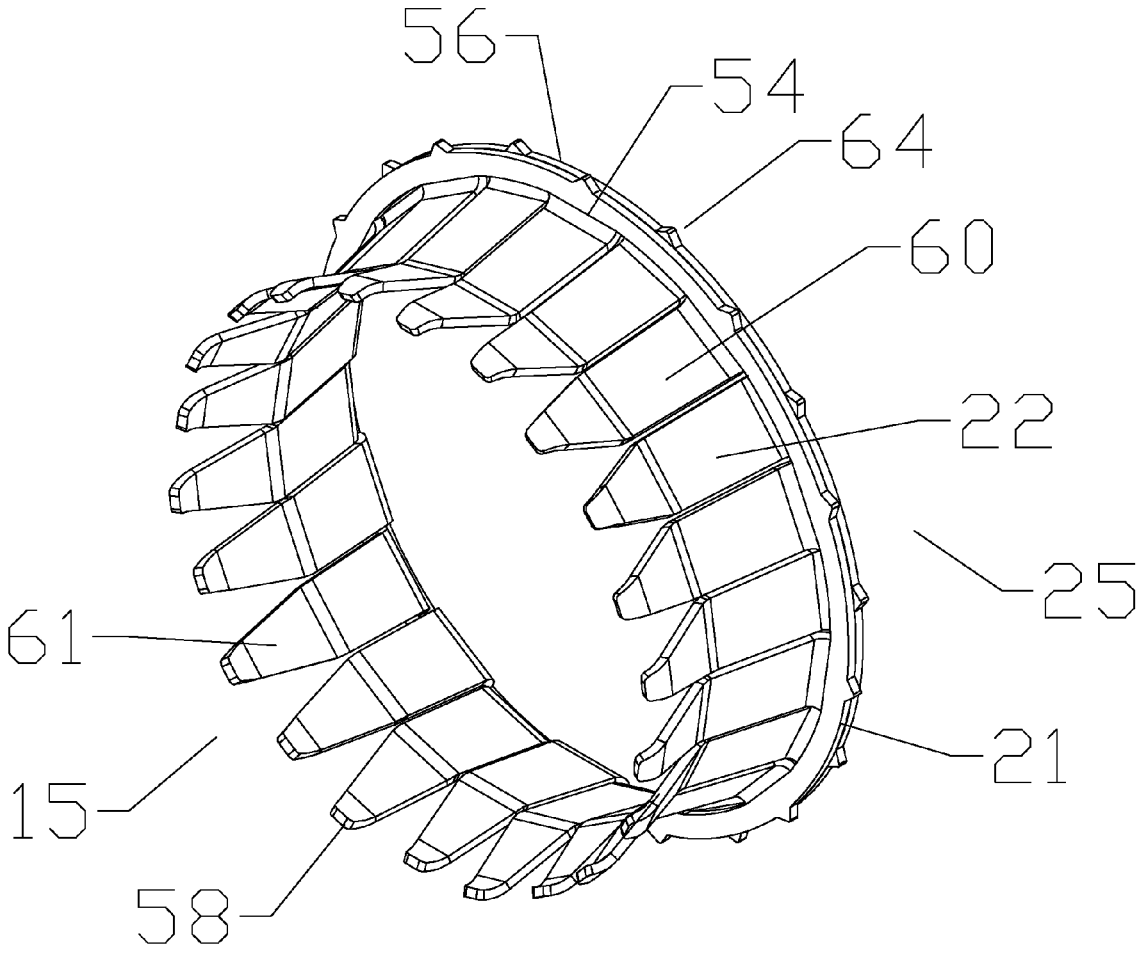
FIG. 24 is a schematic isometric view of a nested spring contact.

To reduce RF leakage through the gap(s) 52, past the spring contact 21 and eventually out the cable end 15 of the coaxial connector 1, the spring contact 21 may be provided as a first ring 54 and a second ring 56 nested together, cable end 15 of the first ring 54 to connector end 25 of the second ring 56, such that the spring finger(s) 22 of each of the first and second rings 54, 56 align contiguously to interleave with one another to form a generally cylindrical surface, as best shown in FIG. 24. To minimize any remaining gap between the interleaved spring finger(s) 22, the gap(s) 52 may be dimensioned to closely mate with the corresponding spring finger(s) 22, for example, provided generally equal to a width of the spring finger(s) 22.

Figure 26:
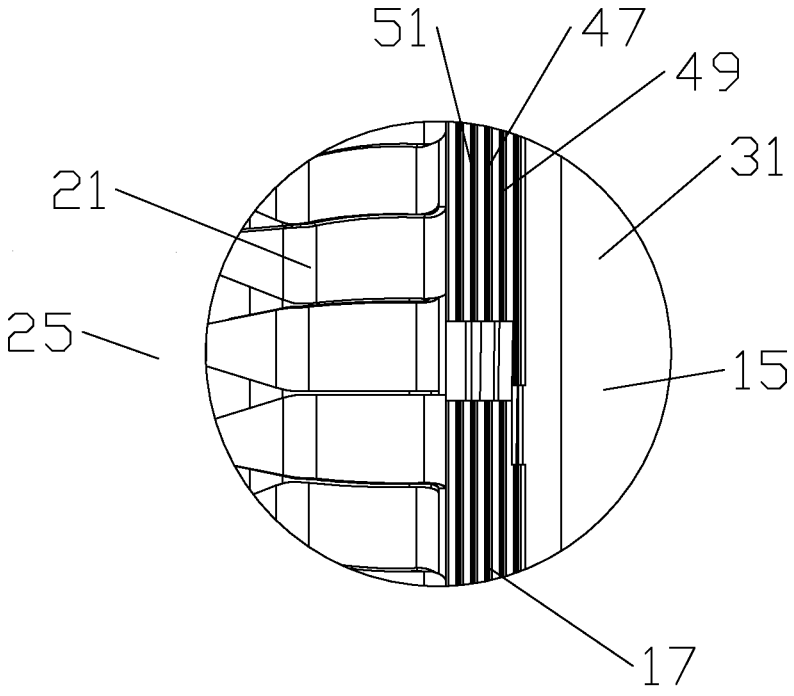
FIG. 26 is a close-up view of FIG. 25.

The first ring 54 and the second ring 56 may be identical dimensionally, resulting in a slight offset of the spring finger 22 extension equal to a width of the first ring 54 when the first ring 54 and the second ring 56 are nested together, as shown for example in FIG. 26. Alternatively, the first portion 60 of the second ring 56 may be increased in length, dimensions of the spring finger widths and the ring diameter permitting, by the width of the first ring 54 so that the resulting spring contact 21 will have spring finger(s) 22 of generally equal lengths.

Figure 25:
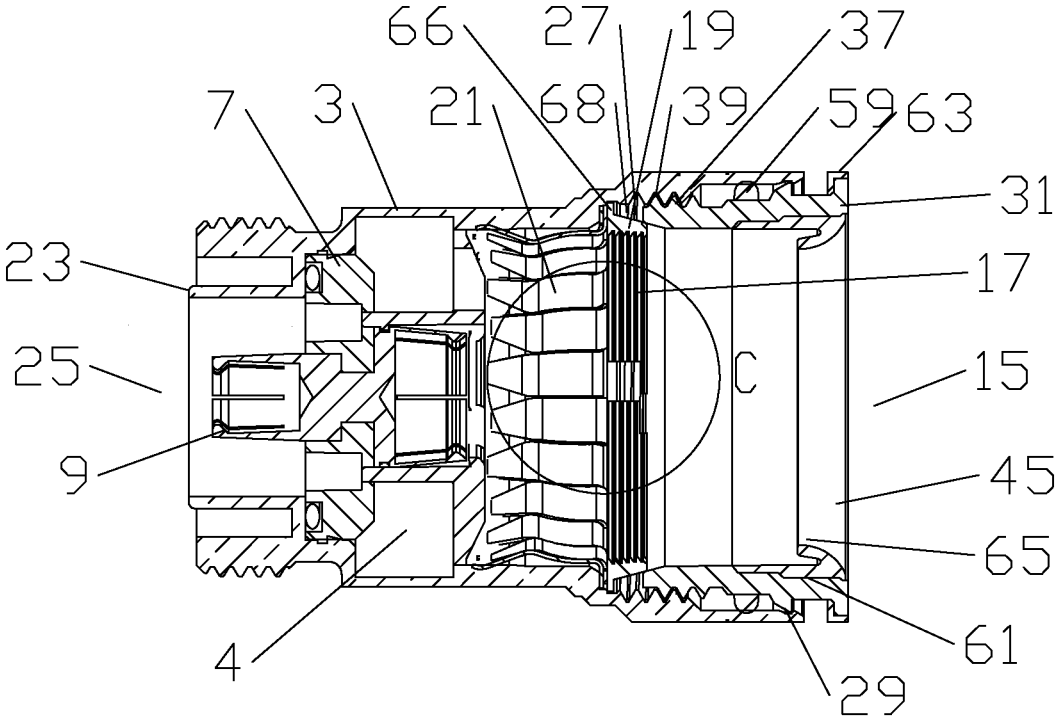
FIG. 25 is a schematic cross-section view of another alternative embodiment of a coaxial connector.
Figure 27:
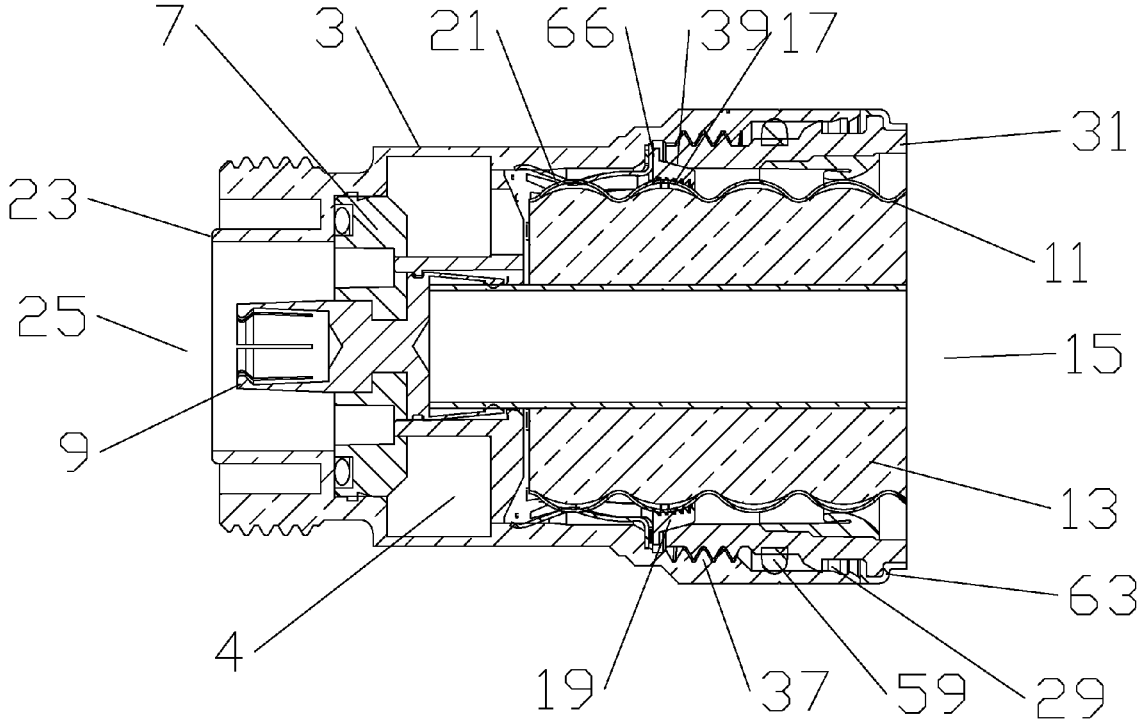
FIG. 27 is a view of FIG. 25, demonstrated with a coaxial cable attached.

As best shown in FIGS. 25-27, the nested spring contact 21 provides a significantly reduced RF leakage pathway and an enhanced electrical contact between the outer conductor 11 and the connector body 3 over a range of outer conductor diameters.

As best viewed in FIGS. 3, 5, 10, 12, 19 and 27, an annular wedge surface 39 within the grip ring groove 27 has a taper between a maximum diameter at a connector end side and a minimum diameter at a cable end side. An outer diameter of the grip ring 19 contacts the wedge surface 39 and is thereby driven radially inward by passage along the wedge surface 39 toward the cable end 15.

The contact between the outer diameter of the grip ring 19 and the wedge surface 39 may be along a corner of the grip ring 19 that may be rounded to promote smooth travel therealong or alternatively the grip ring 19 may be formed with an extended contact area between the grip ring 19 and the wedge surface 39 by angling the outer diameter profile of the grip ring 19 to be parallel to the taper of the wedge surface 39.

The grip ring 19 may be formed as a c-shaped ring, for example as shown in FIGS. 13 and 15-17, with a solid cross-section.

Figure 14:
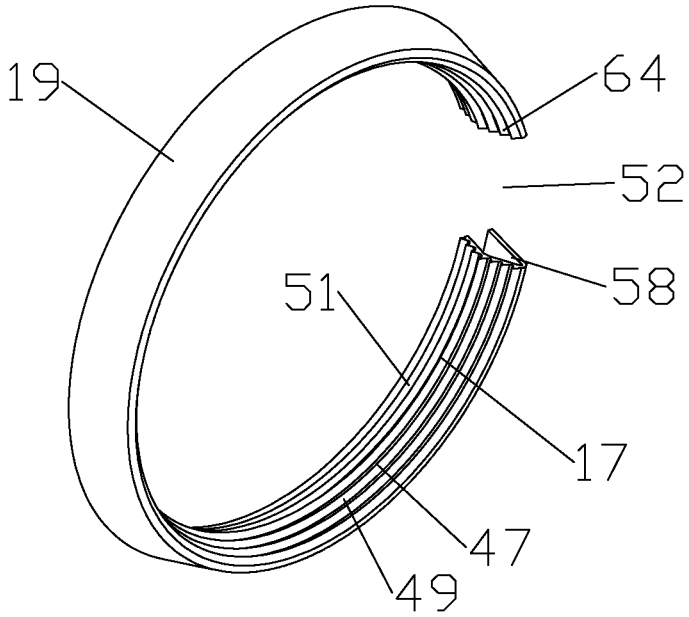
FIG. 14 is a schematic isometric view of a grip ring with a horizontal V cross-section.
Figure 15:
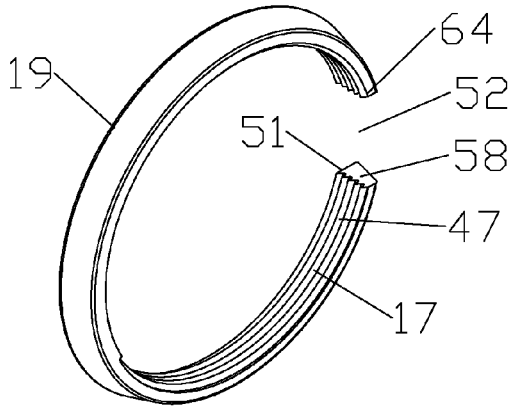
FIG. 15 is a schematic isometric view of a grip ring with a solid cross-section and helical barbs.
Figure 17:
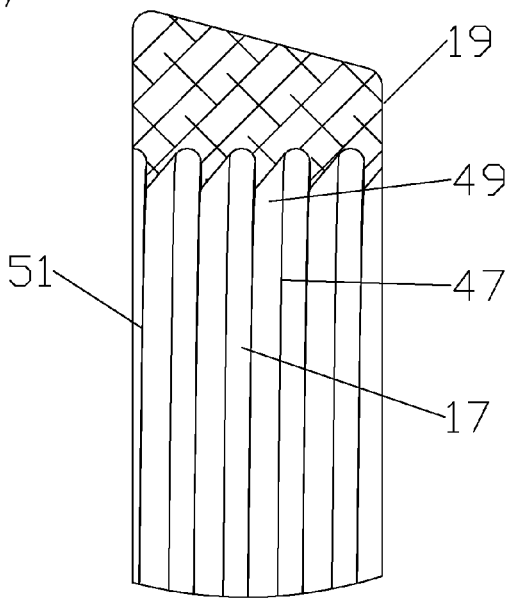
FIG. 17 is a close-up cross section view along line B-B of FIG. 16.
Figure 16:
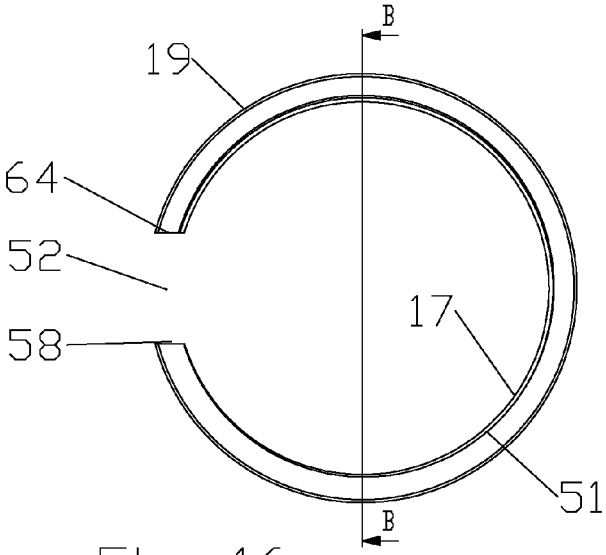
FIG. 16 is a schematic connector end side view of the grip ring of FIG. 15.
Figure 18:
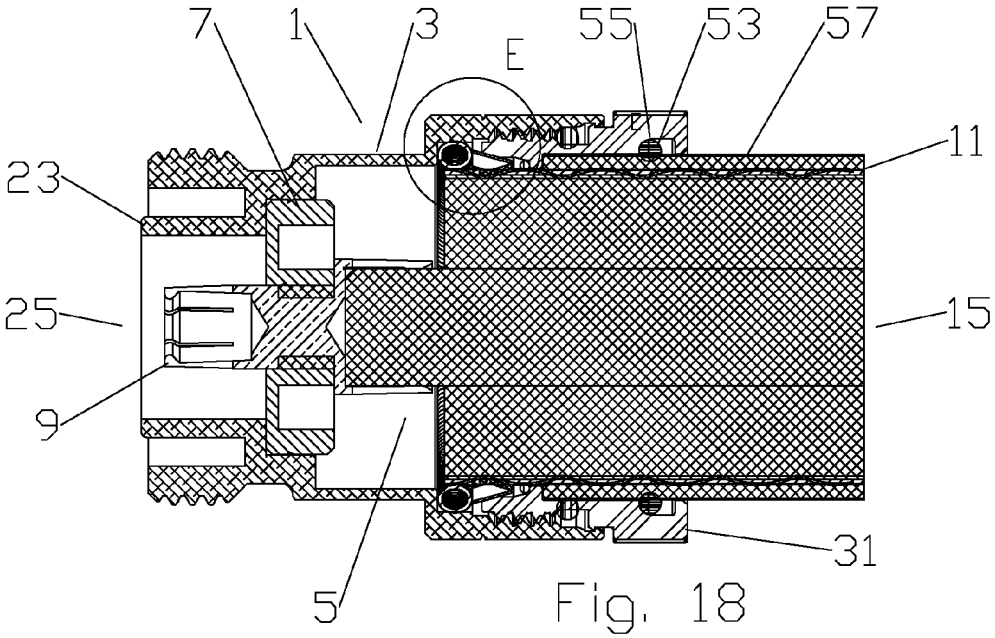
FIG. 18 is a schematic cross-section view of another alternative embodiment coaxial connector, with a section of coaxial cable attached.
Figure 19:
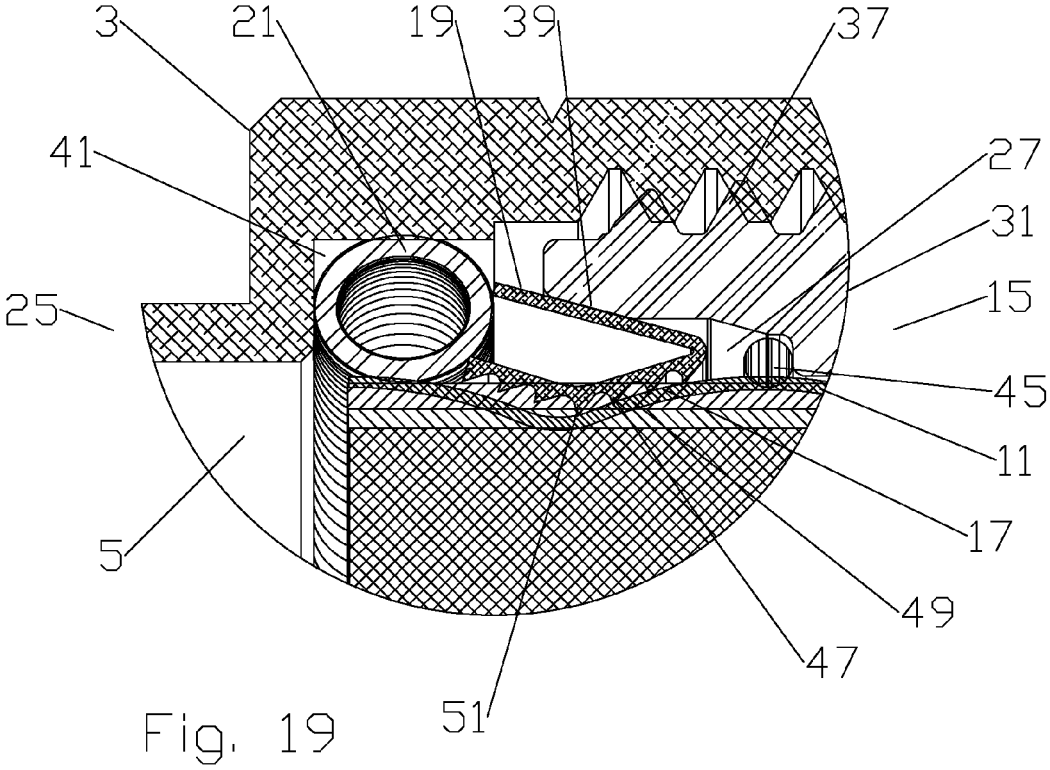
FIG. 19 is a close-up view of area E of FIG. 18.

The grip surface 17 of the grip ring 19 has a directional bias, engaging and gripping the outer diameter surface of the outer conductor 11 when in tension toward the cable end 15 while allowing the outer conductor 11 to slide past the grip surface 17 when moved towards the connector end 25. The grip surface 17 may be formed as a plurality of annular (FIGS. 13-14) or helical (FIGS. 15-17) grooves or barb(s) 47 provided with an angled face 49 extending from a groove bottom on the cable end 15 to a groove top on the connector end 25 of each groove and/or barb 47, the stop face 51 and the angled face 49 of adjacent grooves meeting at the groove top to form a point. A stop face 51 opposite the angled face 49 may be a vertical face with respect to the coaxial connector longitudinal axis and/or the stop face 51 may be angled toward the connector end 25 to present a barb point to grip and retain the outer conductor 11 when travel is attempted in the direction out of the connector body bore 5 toward the cable end 15. The grip surface 17 may be provided with a profile matching the characteristics of a particular solid outer conductor 11, for example a concave curved profile dimensioned to mate with a corrugation trough of an annular corrugated solid outer conductor coaxial cable 13, as shown for example in FIGS. 18 and 19. Similarly, the curved profile may be a convex configuration, dimensioned to cradle a corrugation peak.

The grip ring 19 has a range of longitudinal movement within the grip ring groove 27. As the grip ring 19 moves along the wedge surface 39 toward the connector end 25, for example as the leading edge of the outer conductor 11 is inserted into the connector body bore 5 from the cable end 15 and contacts the angled face(s) 49 of the grip surface 17, the grip ring 19 will either spread to allow the outer conductor to pass through, or will also begin to move longitudinally towards the connector end 25, within the grip ring groove 27. Because of the wedge surface taper, as the grip ring 19 moves towards the connector end 25, the depth of the grip ring groove 27 with respect to the grip ring 19 increases. Thereby, the grip ring 19 may be spread radially outward to enable the passage of the outer conductor 11 through the grip ring 19 and toward the connector end 25. Conversely, once spread, the bias of the grip ring 19 inward towards its relaxed state creates a gripping engagement between the grip surface 17 and the outer diameter surface of the outer conductor 11. If tension is applied between the connector body 3 and the coaxial cable 13 to pull the outer conductor 11 toward the cable end 15, the grip ring 19 is driven against the tapered wedge surface 39, progressively decreasing the depth of the grip ring groove 27, thereby driving the grip ring 19 radially inward and further increasing the gripping engagement as the grip surface 17 is driven into the outer diameter surface of the outer conductor 11. A cable end grip ring groove sidewall may be dimensioned to be at a position where the grip ring diameter relative to the outer conductor diameter is configured for the grip surface 17 to have securely engaged the outer conductor 11 but is short of a grip ring radially inward movement capable of causing the outer conductor 11 to collapse radially inward beyond an acceptable level.

During cable assembly on embodiments with a clamp ring 31 and a retaining feature 29 including the clamp ring threads 37, the limited longitudinal movement obtained by threading the clamp ring 31 into the connector body 3 is operative to drive the wedge surface 39 against the grip ring 19 to move the grip ring 19 radially inward into secure gripping engagement with the outer conductor 11, without requiring the application of tension between the connector body 3 and the coaxial cable 13. Further, in embodiments where the spring contact 21 is also present in the grip ring groove 27, the threading of the clamp ring 31 into the connector body bore 5 may be configured to apply directly, and/or via a spacer 43, if present, pressure on the spring contact 21 whereby the spring contact 21 deforms radially inward toward the outer conductor 11, increasing the contact pressure between the spring contact 21 and the outer conductor 11, thereby improving the electrical coupling therebetween.

One skilled in the art will appreciate the significant manufacturing and installation benefits of the present invention. During manufacturing, a complete coaxial connector 1 assembly ready for installation is prepared with a minimal total number of required elements. If a clamp ring 31 is included in the configuration, the installation of the spring contact 21, spacer 43, grip ring 19 and/or outer conductor seal 45 is simplified by the improved access to the grip ring groove 27, which may then be easily closed by snapping/threading the clamp ring 31 in place after the desired subelements have been seated in the open end(s) of the connector body bore 5 and/or clamp ring 31. To install the coaxial connector 1 upon a coaxial cable 13, the coaxial cable end is stripped back to expose desired lengths of the conductor(s) and the stripped coaxial cable end inserted into the cable end 15 of the connector body bore 5 until bottomed. If present, the clamp ring 31, if including clamp ring threads 37, is then threaded toward the connector body 3 and a test tension between the connector body 3 and the coaxial cable 1 applied to verify secure engagement between the grip ring 19 and the outer conductor 11.

Coaxial connector embodiments with a threaded clamp ring 31 may be uninstalled from the coaxial cable 13 for interconnection inspection and/or reuse by unthreading the clamp ring 31 away from the connector body 3, enabling the grip ring 13 to move outward and away from engagement with the outer conductor 11 as the wedge surface 39 shifts toward the cable end 15 with the clamp ring 31. When the grip ring 13 has disengaged, the coaxial cable 13 may be withdrawn from the connector body bore 5.

The prior manual cable end flaring operations and any required disassembly/reassembly of the various connector elements around the coaxial cable end during installation have been eliminated.

Table of Parts

| | |
|---|---|
| 1 | coaxial connector |
| 3 | connector body |
| 5 | connector body bore |
| 7 | insulator |
| 9 | inner contact |
| 11 | outer conductor |
| 13 | coaxial cable |
| 15 | cable end |
| 17 | grip surface |
| 19 | grip ring |
| 21 | spring contact |
| 22 | spring finger |
| 23 | connector interface |
| 25 | connector end |
| 27 | grip ring groove |
| 29 | retaining feature |
| 31 | clamp ring |
| 33 | snap groove |
| 35 | snap barb |
| 37 | clamp ring threads |
| 39 | wedge surface |
| 41 | spring groove |
| 43 | spacer |

-continued

Table of Parts

| | |
|---|---|
| 45 | outer conductor seal |
| 47 | barb |
| 49 | angled face |
| 51 | stop face |
| 52 | gap |
| 53 | jacket seal |
| 54 | first ring |
| 55 | jacket groove |
| 56 | second ring |
| 57 | jacket |
| 58 | distal end |
| 59 | clamp ring seal |
| 60 | first portion |
| 61 | second portion |
| 63 | clamp ring grip |
| 64 | protrusion |
| 65 | wiper extension |
| 67 | interference fit |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A spring contact for a coaxial connector having a connector end and cable end, the spring contact comprising:

a first ring provided with a plurality of first spring fingers extending toward a connector end of the first ring; and a second ring provided with a plurality of second spring fingers extending toward a connector end of the second ring;

the cable end of the first ring stacks adjacent the connector end of the second ring such that the first spring fingers of the first ring alternate with the second spring fingers of the second ring resulting in a single interleaved generally cylindrical surface.

2. The spring contact of claim 1, wherein a gap between the first and second spring fingers and a finger width of the first and second spring fingers are generally equal to one another.

3. The spring contact of claim 1, wherein a cable end of the first ring abuts the connector end of the second ring.

4. The spring contact of claim 1, wherein the first and second spring fingers of each have a taper proximate a distal end.

5. The spring contact of claim 1, wherein the first and second spring fingers are angled radially inward in a first portion and are angled radially outward in a second portion.

6. The spring contact of claim 1, wherein the first and second spring fingers extend from an inner diameter of the first and second rings, respectively.

7. The spring contact of claim 6, wherein the distal end of the first and second spring fingers are dimensioned to contact a connector body bore of the coaxial connector.

8. The spring contact of claim 1, further including a protrusion extending radially outward from the first ring and the second ring.

9. The spring contact of claim 8, wherein the protrusion is a plurality of protrusions, each protrusion proximate a circumferential position of a spring finger.

10. A method for manufacturing a spring contact for a coaxial connector having a connector end and cable end, comprising the steps of:

providing a first ring with a plurality of first spring fingers extending toward a connector end of the first ring;

providing a second ring provided with a plurality of second spring fingers extending toward a connector end of the second ring; and stacking the cable end of the first ring and the connector end of the second ring adjacent one another such that the first spring fingers of the first ring alternate with the second spring fingers of the second ring resulting in a single interleaved generally cylindrical surface.

11. The method of claim 10, wherein the first ring and the second ring are stamped from a planar material and the first and second spring fingers are bent to extend toward the connector end of the first ring and the second ring.

12. The method of claim 10, wherein the first ring and the second ring are non-ferrous metal.

13. The method of claim 10, wherein the first ring and the second ring are non-magnetic metal.

14. The method of claim 10, wherein the spring fingers extend from an inner diameter of the first ring and the second ring.

15. The method of claim 10, wherein the spring fingers of the second ring are longer than the spring fingers of the first ring, by a thickness of the first ring.

16. The method of claim 10, wherein the spring fingers are provided with a connector body bore contact portion coplanar with a connector body bore of the coaxial connector.

17. The method of claim 10, wherein the first and second spring fingers are angled radially inward in a first portion and are angled radially outward in a second portion.

18. The method of claim 10, wherein the first ring and the second ring are phosphor bronze alloy.

19. The method of claim 18, wherein the first ring and the second ring are tin plated.

* * * * *